United States Patent [19]

Yoshizawa et al.

[11] Patent Number: 4,713,308

[45] Date of Patent: Dec. 15, 1987

[54] ELECTROPHOTOGRAPHIC PHOTOSENSITIVE MEMBER USING MICROCRYSTALLINE SILICON

[75] Inventors: Shuji Yoshizawa, Tokyo; Wataru Mitani; Mariko Yamamoto, both of Yokohama; Akira Sanjoh, Aichi; Tatsuya Ikezue, Tokyo, all of Japan

[73] Assignee: Kabushiki Kaisha Toshiba, Japan

[21] Appl. No.: 877,383

[22] Filed: Jun. 23, 1986

[30] Foreign Application Priority Data

Jun. 25, 1985 [JP] Japan ..... 60-138212
Jun. 25, 1985 [JP] Japan ..... 60-138215
Jun. 25, 1985 [JP] Japan ..... 60-138216
Jun. 25, 1985 [JP] Japan ..... 60-138217

[51] Int. Cl.[4] ..... G03G 5/14

[52] U.S. Cl. ..... 430/65; 430/66; 430/84

[58] Field of Search ..... 430/57, 64, 66, 84, 430/94, 95

[56] References Cited

U.S. PATENT DOCUMENTS 4,265,991 5/1981 Hirai et al. ..... 430/64
4,420,546 12/1983 Kanbe et al. ..... 430/57
4,523,214 6/1985 Hirose et al. ..... 427/87
4,560,634 12/1985 Matsuo et al. ..... 430/95
4,582,773 4/1986 Johncock et al. ..... 430/64

FOREIGN PATENT DOCUMENTS

0066812A2 12/1982 European Pat. Off. .

OTHER PUBLICATIONS

Solar Energy Materials 11 (1984), pp. 85–95.

*Primary Examiner*—John L. Goodrow
*Attorney, Agent, or Firm*—Schwartz, Jeffery, Schwaab, Mack, Blumenthal & Evans

[57] ABSTRACT

In an electrophotographic photosensitive member according to the present invention, a barrier layer is formed on a conductive substrate, and a photoconductive layer on the barrier layer. The photoconductive layer is formed of a microcrystalline silicon layer, whose crystallinity varies all the way through its thickness. The higher the crystallinity of the microcrystalline silicon layer, the more distinguishable are the crystalline properties, the narrower is the optical band gap, and the higher is the sensitivity to long-wavelength light. If the crystallinity becomes lower, then the amorphous properties are enhanced, and the resistance is increased in proportion. Thus, the chargeability and the sensitivity to long-wavelength light of the microcrystalline silicon layer can be improved by varying its crystallinity in the photoconductive layer.

18 Claims, 5 Drawing Figures

ELECTROPHOTOGRAPHIC PHOTOSENSITIVE MEMBER USING MICROCRYSTALLINE SILICON

BACKGROUND OF THE INVENTION

The present invention relates to an electrophotographic photosensitive member with improved chargeability, photosensitivity, and environmental durability.

Organic and inorganic materials have conventionally been used to form photoconductive layers of electrophotographic photosensitive members. Among the inorganic materials are CdS, ZnO, selenium, Se-Te system, and amorphous silicon. The organic materials include poly-N-vinyl carbazole (PVCz) and trinitrofluorenone (TNF). In the photosensitive members using these photoconductive materials, however, there are various problems related to their photoconductive characteristics and workmanship. Therefore, the characteristics of the photosensitive system have been sacrificed, in some measure, in using these materials properly according to the applications.

For example, selenium and CdS are harmful to health, and must be prepared with special care for safety's sake. Accordingly, they require complicated manufacturing apparatuses and thereby entail high production costs. In particular, selenium must be recovered and this necessitates additional cost. Moreover, selenium and Se-Te system, whose crystallization temperature is as low as 65° C., will be confronted with problems related to their photoconductive characteristics, such as residual potential, during repeated copying operations. Therefore, they are short-lived and are not very practical.

Further, ZnO is not reliable in use because it is liable to oxidize or reduce, and is highly susceptible to the environmental atmosphere.

It is suspected, furthermore, that organic photoconductive materials such as PVCz and TNF are carcinogens. Besides being harmful to health, they have low thermal stability and wear resistance, and are therefore short-lived.

Meanwhile, amorphous silicon (hereinafter abbreviated to a-Si) is a photoconductive material which has recently become the object of public attention. It is frequently applied to solar cells, thin-film transistors, and image sensors. As a part of such applications, a-Si has been tried as a material for electrophotographic photosensitive members. Since a-Si produces no pollutant, photosensitive members formed of a-Si need not be recovered. Also, they have higher spectral sensitivity in the visible radiation area than those made of other materials have, and have high surface hardness, wear resistance, and shock resistance.

Amorphous silicon is being studied as a material of photosensitive members for electrophotography, based on the Carlson process. In this connection, the members must have high resistance and photosensitivity. It is difficult, however, for a single-layer photosensitive member to provide both these characteristics. To meet these requirements, therefore, laminate-type photosensitive members have been developed, which are constructed so that a barrier layer is sandwiched between a photoconductive layer and a conductive substrate, and a surface charge retentive layer is formed on the photoconductive layer.

Usually, a-Si is formed by the glow discharge decomposition process, using silane gas. In this process, hydrogen is trapped in an a-Si film, so that the electrical and optical characteristics of the film vary considerably, depending on the hydrogen content. If the amount of hydrogen incorporated in the a-Si film increases, the optical band gap becomes greater, thereby increasing the resistance of the film, so that the film has reduced sensitivity to long wavelength light. It is therefore difficult to use it suitably, for example, in a laser beam printer mounted with a semiconductor laser. If the hydrogen content of the a-Si film is high, $(SiH_2)_n$ and other bonds may sometimes occupy the greater part of the film, depending on the filming conditions. Thereupon, voids spread, thereby increasing silicon dangling bonds and lowering the photoconductive characteristics. Thus, the film cannot be used for an electrophotographic photosensitive member. If the amount of hydrogen incorporated in the a-Si film is reduced, on the other hand, the optical band gap is narrowed, thus reducing the resistance of the film, although the film now has increased sensitivity to longer-wave light. If the hydrogen content is low, however, less hydrogen links with the silicon dangling bonds, thereby reducing them. Accordingly, the mobility of resulting carriers is reduced, and the film has lower life performance and photoconductive characteristics. Thus, the film becomes unfit for use in the photosensitive member.

In a conventional method of increasing the sensitivity to longer-wave radiation, silane gas is mixed with germane ($GeH_4$) and subjected to glow discharge decomposition, thereby forming a film with a narrow optical band gap. In general, silane gas and $GeH_4$ are different in their optimum substrate temperature, so that the resultant film is subject to many structural defects and cannot provide satisfactory photoconductive characteristics. Moreover, waste gas from $GeH_4$ becomes poisonous when it is oxidized, and thus requires a complicated processing system. In consequence, this technique is not practical.

SUMMARY OF THE INVENTION

The object of the present invention is to provide an electrophotographic photosensitive member which enjoys improved chargeability, low residual potential, high sensitivity over a wide wavelength range, good adhesion to substrate, and improved environmental capability.

According to the present invention, there is provided an electrophotographic photosensitive member which comprises a conductive substrate, a barrier layer provided on the conductive substrate, and a photosensitive layer provided on the barrier layer, at least part of said photosensitive layer being formed of microcrystalline silicon, the crystallinity of said microcrystalline silicon varying all the way through the thickness of the photosensitive layer.

The present invention is based on the results of various experiments conducted by the inventors hereof. The electrophotographic photosensitive member of the invention at least partially includes microcrystalline silicon (hereinafter abbreviated to μc-Si) as a photosensitive material, thereby eliminating the aforementioned drawbacks of the prior art and providing good photoconductive or electrophotographic characteristics and high environmental capability.

The present invention is characterized in that μc-Si is used in place of a-Si, used as the prior art material. The entire region or part of the photosensitive member is formed of μc-Si, or a mixture of μc-Si and a-Si, or a laminate structure of μc-Si and a-Si. In a separate-function photosensitive member, μc-Si is used for a charge generating layer.

Microcrystalline silicon is clearly distinguishable from a-Si and polycrystalline silicon by the following physical properties: In an X-ray diffraction measurement, a-Si develops only halos and produces no diffraction pattern, due to its amorphousness, while μc-Si produces a crystal diffraction pattern with $2\theta$ ranging from 27 to 28.5 degrees. While the dark resistance of polycrystalline silicon is $10^6$ Ω·cm, that of μc-Si is $10^{11}$ Ω·cm or more. Microcrystalline silicon is an aggregate consisting of microcrystalline with a grain diameter of tens of angstroms or more.

The mixture of μc-Si and a-Si is a substance in which the crystal structure of μc-Si is present in a-Si, so that both materials are equal in volume. The laminate structure of μc-Si and a-Si is a structure which includes a layer formed mainly of a-Si and a layer stuffed with μc-Si.

The photoconductive layer including μc-Si, like the one including a-Si, can be formed by depositing μc-Si on a conductive substrate by the high-frequency glow discharge decomposition process, using silane gas as the material. The formation of μc-Si is facilitated if the substrate temperature and high-frequency power are set higher than in the case of the a-Si layer. If the temperature and power are higher, then the flow volume of the material, such as silane gas, can be increased in proportion, thereby permitting faster filming. Further, μc-Si can be formed more efficiently by diluting $SiH_4$, $Si_2H_6$, or another silane gas of higher order, with hydrogen.

The μc-Si has an optical band gap of approximately 1.6 eV, as compared to 1.65 to 1.7 eV gap of a-Si. In general, a photoconductive layer absorbs those components of incident light which have greater energy than the optical band gap of the layer, and produces carriers correspondingly. Meanwhile, longer-wave light, such as near-infrared radiation, has less energy than visible radiation. Therefore, a-Si, which has sufficiently high sensitivity to visible light, has only a low sensitivity to near-infrared radiation or other longer-wave light. On the other hand, μc-Si, whose optical band gap is smaller than that of a-Si, has sufficiently high sensitivity to longer-wave light. Thus, it produces carriers when exposed to longer-wave light. In a laser printer mounted with a semiconductor laser, the oscillation wavelength of the laser is 790 nm, falling within the range for near-infrared radiation. If μc-Si is used in a part of the photoconductive layer, as in the present invention, the layer enjoys a high photosensitivity over a wide range covering both visible radiation and near-infrared radiation. Thus, the present invention may be applied to laser printers, as well as plain paper copiers (PPC).

According to the present invention, moreover, the crystallinity of the μc-Si of the photosensitive layer varies all the way through the layer thickness. Although μc-Si, akin to a crystal, has lower resistance than a-Si, it has higher sensitivity to long-wavelength radiation than a-Si. By varying the crystallinity of the μc-Si layer all the way through the layer thickness, therefore, the photosensitive layer can be improved in resistance, to achieve higher chargeability and higher photosensitivity in a wide range of wavelength covering both visible radiation and near-infrared radiation (e.g., centering around a wavelength of 790 nm, equivalent to the oscillation wavelength of semiconductor laser).

According to the invention, furthermore, there may be provided an electrophotographic photosensitive member which enjoys high resistance, improved charging capability, and high sensitivity to both visible and near-infrared radiations, and is highly practical and easy to manufacture.

DETAILED DESCRIPTION OF THE PREFERRED EMBODIMENTS

Figure 1:
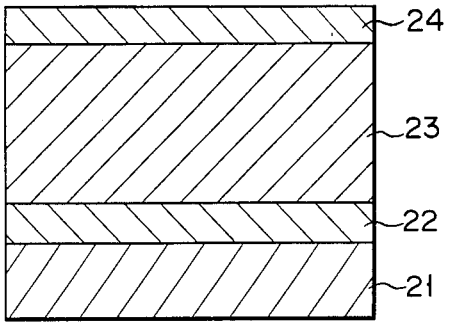
FIGS. 1 and 2 are partial sectional views showing electrophotographic photosensitive members according to an embodiment of the present invention.
Figure 2:
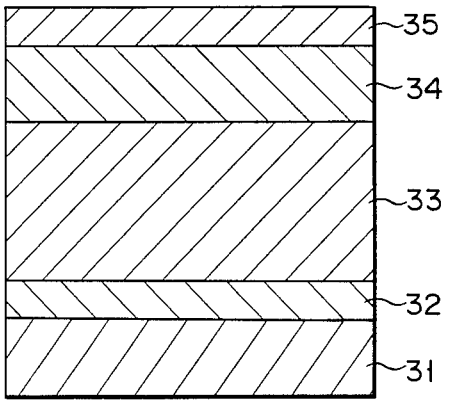

An embodiment of the present invention will now be described in detail. FIGS. 1 and 2 are partial sectional views showing electrophotographic photosensitive members according to the embodiment. In FIG. 1, barrier layer 22 is formed on conductive substrate 21; photoconductive layer 23 on layer 22, and surface layer 24 on layer 23. In the member shown in FIG. 2, barrier layer 32 is formed on conductive substrate 31; charge transport layer (CTL) 33 on layer 32, charge generating layer (CGL) 34 on layer 33, and surface layer 35 on layer 34.

The microcrystalline silicon constituting photoconductive layer 23 or CGL 34 is more or less of an n-type. Therefore, layer 23 is preferably light-doped (to $10^{-7}$ to $10^{-3}$ atomic percent) with an element included in group III of the periodic table. The doping converts layer 23 or CGL 34 to an i-type (intrinsic) semiconductor, whose dark resistance is high, and whose signal-to-noise ratio and chargeability are improved.

Also, μc-Si layer preferably contains at least one element selected from carbon, oxygen, and nitrogen so that the photosensitive member has improved electric charge retentivity. The doping element or elements act as a terminator for silicon dangling bonds. Thus, the state density of the dangling bonds in forbidden bands between energy bands is lowered, so that the dark resistance is increased.

Photoconductive layer 23 or CGL 34 may be formed substantially wholly from μc-Si or from a mixture of laminate structure of a-Si and μc-Si. The laminate structure has higher chargeability, while the mixture has higher sensitivity to light with a long wavelength corresponding to the infrared region. These two structures are substantially equal in sensitivity to visible radiation. Thus, the photoconductive layer may be formed in an alternative manner, depending on the application of the photosensitive member.

The μ-Si contains 0.1 to 30 atomic percent hydrogen, preferably 1 to 10 atomic percent. Thus, the dark and light resistances are well-matched for improved photoconductive characteristics. In this case, it is supposed that hydrogen exists around μc-Si grains, or in a-Si which exists among μc-Si grains, and is in linkage with silicon atoms. In doping the μc-Si layer with hydrogen by, e.g., the glow discharge decomposition process, $SiH_4$, $Si_2H_6$, or other silane gas, as a material gas, and hydrogen, as a carrier gas, are introduced into a reaction container for glow discharge. Alternatively, the gas mixture for the reaction may be a combination of hydrogen gas and silicon halide, such as $SiF_4$, $SiCl_4$, etc., or of silane gas and silicon halide. Moreover, the μc-Si layer may be formed by sputtering or by another physical method, as well as by the glow discharge decomposition process. With regard to the photoconductive characteristics, the photoconductive layer including μc-Si preferably has a thickness of 3 to 80 μm, more preferably 5 to 50 μm.

Figure 3:
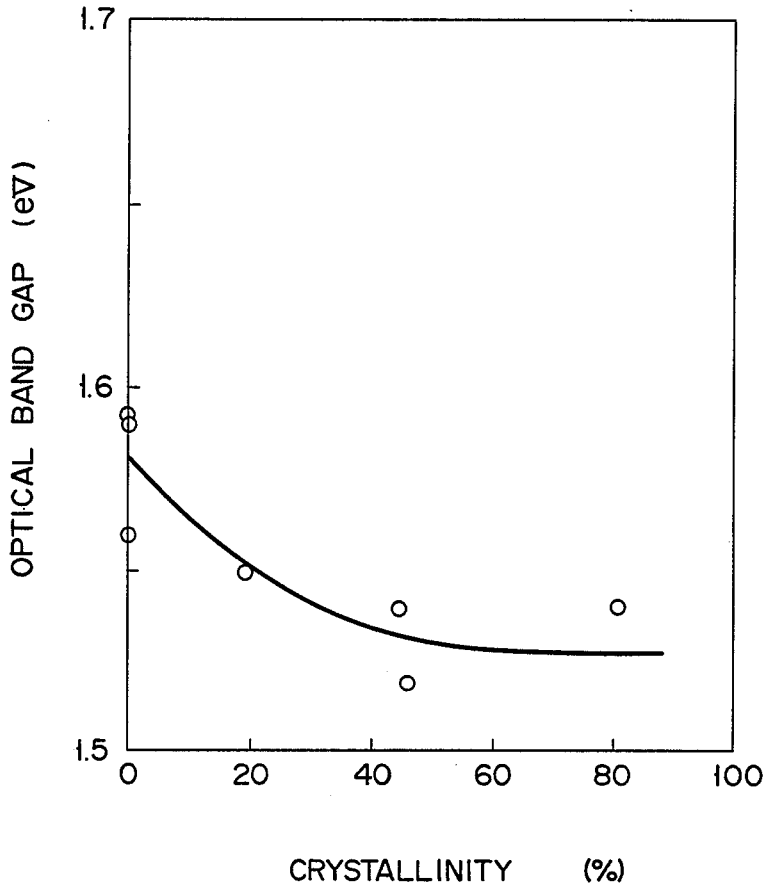
FIG. 3 is a graph showing the relationship between crystallinity and optical band gap.

The present invention is characterized in that the crystallinity of the μc-Si layer constituting photoconductive layer 23 or CGL 34 varies all the way through the layer thickness. Since μc-Si has a narrow optical band gap, it is highly sensitive to long wavelength light, such as near-infrared radiation. Akin to a crystal, however, μc-Si has lower resistance than a-Si. FIG. 3 shows the relationship between crystallinity (abscissa) and optical band gap (ordinate). As seen from FIG. 3, the lower the crystallinity, the poorer are the crystalline properties, the greater is the band gap, and the lower is the sensitivity to long-wavelength light. If the crystallinity becomes higher, then the crystalline properties are improved, the band gap is narrowed, and the sensitivity to long-wavelength light is increased in proportion. By varying the crystallinity of the μc-Si layer all the way through its thickness, therefore, layer 23 or CGL 34 can be improved in resistance, thereby achieving higher chargeability and for higher photosensitivity in a wide range of wavelengths covering both visible radiation and near-infrared radiation (e.g., centering around a wavelength of 790 nm, equivalent to the oscillation wavelength of semiconductor laser). Thus, the photosensitive member can be used for both plain paper copiers (PPC) and laser printers.

Figure 4A:
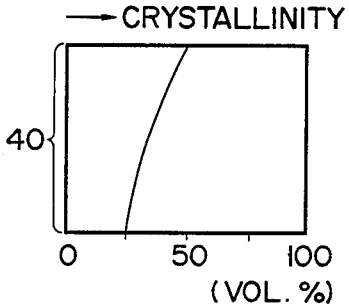
FIGS. 4A to 4Z are diagrams showing variations of crystallinity.
Figure 4B:
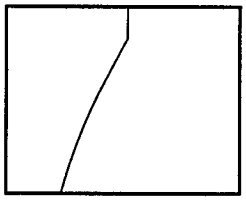
Figure 4C:
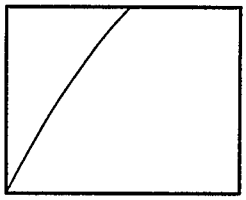
Figure 4D:
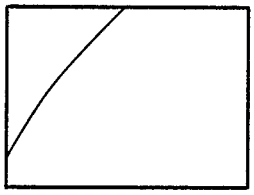
Figure 4E:
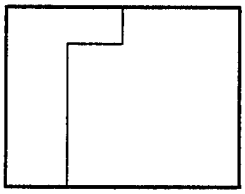
Figure 4F:
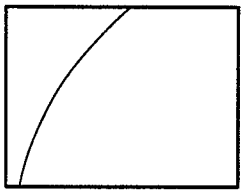
Figure 4G:
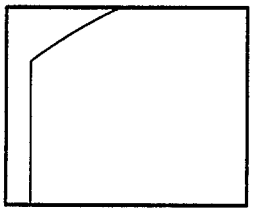
Figure 4H:
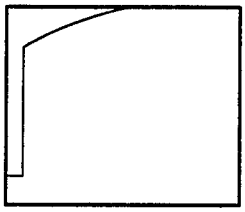
Figure 4I:
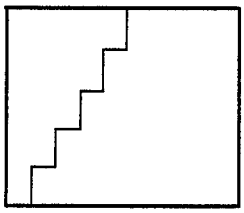
Figure 4J:
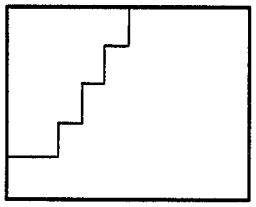
Figure 4K:
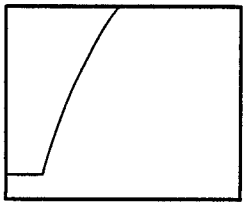
Figure 4L:
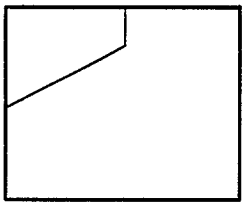
Figure 4M:
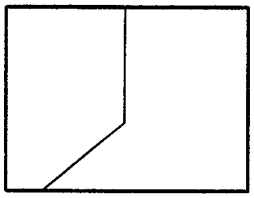
Figure 4N:
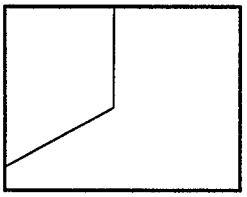
Figure 4O:
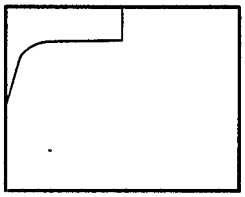
Figure 4P:
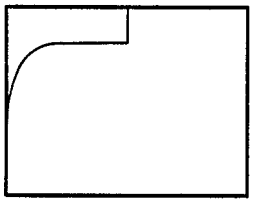
Figure 4Q:
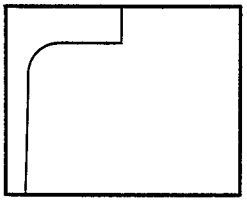
Figure 4R:
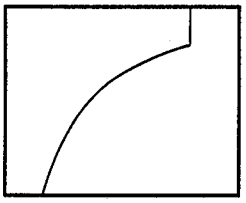
Figure 4S:
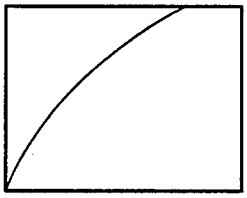
Figure 4T:
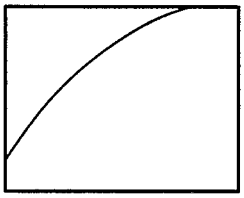
Figure 4U:
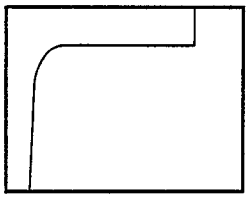
Figure 4V:
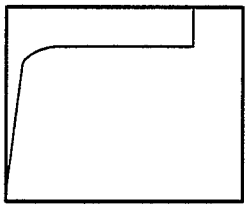
Figure 4W:
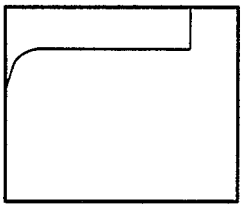
Figure 4X:
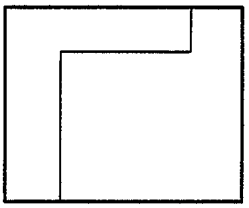
Figure 4Y:
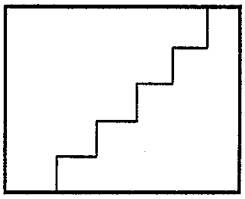
Figure 4Z:
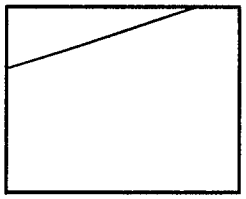
Figure 5:
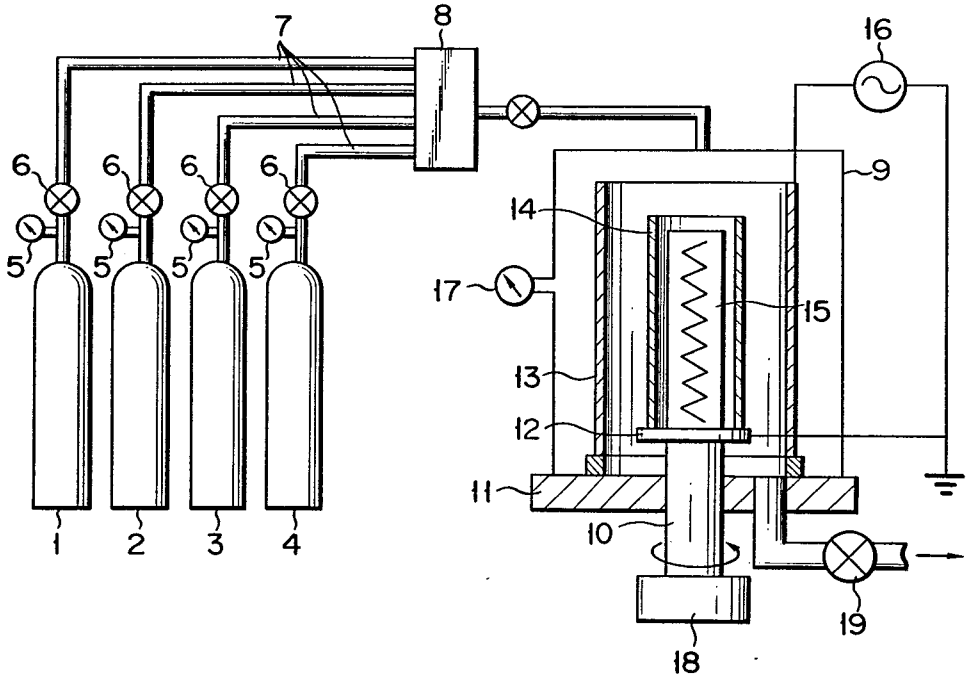
FIG. 5 shows an apparatus for manufacturing the photosensitive members of the invention.

FIGS. 4A to 4Z are diagrams showing examples of crystallinity transition patterns, in which the abscissa and ordinate represent crystallinity (% by volume) and the thickness of μc-Si layer 40 (photoconductive layer 23 or CGL 34). The crystallinity of μc-Si layer 40 preferably ranges from zero to 80 percent by volume. More preferably, it should range from 10 to 50 percent for higher dark resistance, to improve photosensitivity. The crystallinity can be lowered or increased with distance from substrate 21 or 31, all the way through the layer thickness. For higher sensitivity to long-wavelength light, and specifically for effective use in semiconductor laser printers, however, those patterns are preferable in which the crystallinity decreases with distance from surface layer 24 or 35.

The filming with varying crystallinity can be accomplished by gradually reducing hydrogen gas flow or high-frequency power, after high-frequency glow discharge decomposition using a gas mixture of hydrogen gas and silane gas, such as $SiH_4$.

Also, the mean grain size of μc-Si layer 40, constituting photoconductive layer 23 or CGL 34, may be varied all the way through the layer thickness. The greater the grain size of layer 40, the more distinguishable are the crystalline properties peculiar to μc-Si, the better is the carrier running capability, and the lower is the resistance. By varying the crystallinity of μc-Si layer 40 all the way through its thickness, therefore, layer 23 or 34 can be improved in resistance, thereby achieving higher chargeability and carrier running capability, and higher photosensitivity in the wide range of wavelengths covering both visible radiation and near-infrared radiation.

The mean grain size of μc-Si preferably ranges from 10 to 400 angstroms. More preferably, it should range from 20 to 100 angstroms for higher dark resistance to improve photosensitivity. The mean grain size can be reduced or increased, in relation to the distance from substrate 21 or 31, all the way through the layer thickness. For higher sensitivity to long-wavelength light, and specifically for effective use in semiconductor laser printers, however, those patterns are preferable in which the mean grain size decreases, in relation to the distance from surface layer 24 or 35. The filming with varying mean grain size can be accomplished by gradually reducing hydrogen gas flow or high-frequency power, after high-frequency glow discharge decomposition using a gas mixture of hydrogen gas and silane gas, such as $SiH_4$.

Barrier layer 22 or 32 serves to prevent injection of electrons or holes from substrate 21 into photoconductive layer 23 or CGL 34, when in darkness. When irradiated, layer 22 or 32 allows a charge produced in photoconductive layer 23 or CGL 34 to pass to the side of substrate 21 at a high rate. Thus, the charge holding capability of the surface of the photosensitive member and its chargeability can be improved. Barrier layer 22 or 32 can be formed of μc-Si or a-Si.

In positively charging the photosensitive member surface according to the Carlson process, the barrier layer is converted to a p-type semiconductor, in order to prevent electrons from being injected into the photoconductive layer from the substrate side. In negatively charging the surface, on the other hand, the barrier layer is changed to an n-type semiconductor, in order to prevent holes from being injected into the photoconductive layer from the substrate side.

In converting μc-Si layer into a p-type semiconductor, it is preferably doped with an element included in group III of the periodic table, e.g., boron, aluminum, gallium, indium, thallium, etc. In converting it into an n-type semiconductor, it is preferably doped with an element included in group V of the periodic table, e.g., nitrogen, phosphorus, arsenic, antimony, bismuth, etc. By being doped with the p- or n-type impurity, the charge carriers are prevented from moving from the substrate side to the photoconductive layer. Preferably, the doping element content for determining the conductivity type ranges from $10^{-3}$ to 10 atomic percent. If barrier layers 22 and 32 contain at least one element selected from carbon, oxygen, and nitrogen at a rate of 0.1 to 20 atomic percent, they are further improved in charge blocking capability, and therefore in electrophotographic characteristics. The thickness of layers 22 and 32 preferably ranges from 0.01 to 10 μm, and more preferably from 0.1 to 2 μm.

Surface layers 24 and 35 are formed of a-Si containing at least one element selected from carbon, oxygen, and nitrogen. Since μc-Si or a-Si of photoconductive layer 23 or CGL 34 has a relatively high refractive index of 3 or 4, the layer surface is liable to reflect light. If such light reflection occurs, the quantity of light beams absorbed by the layer is lowered, thereby increasing loss of light. Preferably, therefore, surface layer 25 is used to prevent such reflection. Layer 25 also serves to protect the layer 23 or 34 against damage and thereby improve the chargeability of its surface. Thus, the photoconductive layer or charge generating layer is improved in its environmental capability. The carbon, oxygen and/or nitrogen content of layer 24 preferably ranges from 10 to 50 atomic percent. The thickness of surface layers 24 and 35 preferably ranges from 0.01 to 10 μm, and preferably from 0.1 to 2 μm.

The electrophotographic photosensitive member is not limited to the arrangement of FIG. 1, in which the substrate 21, barrier layer 22, photosensitive layer 23 as a single photoconductive layer, and surface layer 24 are successively stacked for lamination. As shown in FIG. 2, for example, the photoconductive layer may be of a separate-function configuration including a charge transport layer (CTL) 33 and a charge generating layer (CGL) 34 on the CTL. The CGL 34 generates carriers when irradiated. It is partially or wholly formed of microcrystalline silicon or μc-Si, and its thickness preferably ranges from 0.1 to 10 μm. The CTL 33 is a layer which causes the carriers generated in the CGL 34 to reach the substrate side at a high rate. Accordingly, the carriers must have high mobility and transportability, as well as a long life. The CTL 33 can be formed of a-Si containing hydrogen. To improve its dark resistance for higher chargeability, it is preferably light-doped with an element included in group III of the periodic table. For further improved chargeability and double function for both layers, the CTL 33 may contain at least one element selected from carbon, nitrogen, and oxygen. In consideration of the carrier running capability, the carbon, oxygen and/or nitrogen content is preferably restricted to 20 atomic percent or less. If the CTL 33 is too thin or too thick, it cannot satisfactorily fulfill its function. Preferably, it has a thickness of 3 to 80 μm.

FIG. 3 shows an apparatus for manufacturing the electrophotographic photosensitive member according to the present invention. Gas cylinders 1, 2, 3 and 4 contain material gases such as $SiH_4$, $B_2H_6$, $H_2$, and $CH_4$, respectively. The gases in cylinders 1 to 4 are fed into mixer 8 through pipes 7. Each cylinder is provided with pressure gage 5. The flow rate and mixture ratio of the material gases supplied to mixer 8 can be adjusted by controlling valve 6 while watching the pressure gage. The gas mixture resulting from mixing in mixer 8 is fed into reaction container 9. Rotating shaft 10 is attached to bottom portion 11 of container 9, so as to be rotatable around a vertical axis. Disk-shaped support 12 is fixed to the upper end of shaft 10 so that its surface extends at right angles to the shaft. Inside container 9, cylindrical electrode 13 is mounted on portion 11 so as to be coaxial with shaft 10. Drum base 14 of the photosensitive member is mounted on support 12, with its axis in alignment with that of shaft 10. Drum base heater 15 is located in the drum base. High-frequency power source 16 is connected between electrode 13 and base 14, whereby high-frequency current is supplied between the two. Shaft 10 is rotated by motor 18. The pressure inside reaction container 9 is monitored by pressure gage 17, and the container is coupled to a suitable exhaust means, such as a vacuum pump, through gate valve 19.

In manufacturing the photosensitive member by means of the apparatus constructed in this manner, drum base 14 is set in reaction container 9, and gate valve 19 is then opened to gas-purge the container to a pressure of 0.1 torr or less. Then, the necessary reaction gases from cylinders 1 to 4 are mixed at a predetermined mixture ratio and introduced into container 9. In this case, the flow rate of the gas mixture fed into container 9 is set so that the pressure inside the container ranges from 0.1 to 1 torr. Subsequently, motor 18 is started to rotate drum base 14, and the base is heated to a fixed temperature. At the same time, high-frequency power source 16 supplies high-frequency current between electrode 13 and base 14, thereby causing glow discharge between them. As a result, microcrystalline silicon (μc-Si) is deposited on drum base 14. The μc-Si layer may be caused to contain elements included in $NH_3$, $NO_2$, $N_2$, $CH_4$, $C_2H_4$, and $O_2$ gases by using these gases as the material gases.

Thus, the electrophotographic photosensitive member according to the present invention, like the prior art one using a-Si, can be made by the use of a closed-type manufacturing apparatus, which has high safety. Highly resistant to heat, moisture and wear, the photoconductive layer of the member can stand prolonged, repeated use with less deterioration, thus ensuring a long life. Moreover, there is no need of sensitizing gas, such as $GeH_4$, for enhancing the sensitivity to long-wavelength light. Therefore, it is not necessary to provide any exhaust-gas processing equipment. Thus, the efficiency of industrial production is very high.

Examples of the present invention will now be described.

EXAMPLE 1

After an aluminum drum, for use as a conductive substrate was washed and dried, it was heated to 350° C. while the reaction container was being gas-purged by a diffusion pump. After about one hour of heating, the degree of vacuum in the container reached $3\times10^{-5}$ torr, whereupon the drum temperature was stabilized. Then, 300 SCCM of $SiH_4$ gas, $B_2H_6$ gas with a $5\times10^{-4}$ flow-rate ratio to the $SiH_4$ gas, 60 SCCM of $CH_4$ gas, and 200 SCCM of argon gas were mixed and fed into the reaction container. High-frequency power of 200 W was applied to the gas mixture at 13.56 MHz for glow discharge, to form barrier layer 21. The pressure inside the reaction container, at that time, was approximately 0.8 torr, and the layer thickness obtained was 1.5 μm. Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$ and $SiH_4$ was adjusted to $8\times10^{-8}$. Then, high-frequency power of 450 W was applied at a reaction pressure of 1.5 torr, for 15 minutes of filming. Subsequently, the high-frequency power was reduced to zero, and the hydrogen gas, along with the other gases, was fed at a reduced flow rate of 400 SCCM for 5 minutes. After the gas flow stabilized, high-frequency power of 450 W was applied at a pressure of 1.4 torr, for 15 minutes of filming. Thereafter, the high-frequency power was reduced to zero, and the flow rate of the hydrogen gas was lowered to 300 SCCM and maintained for 5 minutes. When the reaction pressure reached 1.35 torr after the gas flow stabilized, high-frequency power of 450 W was applied for filming. Then, the high-frequency power was reduced to zero, and the flow rate of the hydrogen gas was lowered to 200 SCCM and maintained for 5 minutes. After the gas flow stabilized, high-frequency power was applied at a reaction pressure of 1.2 torr, for 30 minutes of filming. The area ratios between wide diffraction patterns, peculiar to amorphous silicon, and diffraction peaks at a diffraction angle of 28.3 degrees, were measured by the X-ray diffraction method on the photoconductive layer obtained in this manner. The measurement results indicated that the crystallinity varied in the order of 45%, 32%, 25%, and 18% by volume with distance from substrate 21. The thickness of the photoconductive layer used was 25 micrometers.

Then, all the gas flows were stopped, and the container was gas-purged for 15 minutes. Thereafter, 100 SCCM of $SiH_4$ gas and 400 SCCM of nitrogen gas were fed, and high-frequency power of 200 W was applied at a reaction pressure of 0.7 torr, to form a surface layer of 1.0-μm thickness. A laser printer, mounted with a semiconductor laser of 790-nm oscillation wavelength, was used to form an image on the photosensitive member filmed in this manner. The resultant image was a distinct one, with high resolution, and was free from fog and unevenness in density. Moreover, the half-life exposure was as high as 8 erg/cm$^2$.

EXAMPLE 2

After an aluminum drum, for use as a conductive substrate, was washed and dried, it was heated to 300° C. while the reaction container was being gas-purged by a diffusion pump. After about one hour of heating, the degree of vacuum in the container reached $3\times10^{-5}$ torr, whereupon the drum temperature was stabilized. Then, 300 SCCM of $SiH_4$ gas, $B_2H_6$ gas with a $5\times10^{-4}$ flow-rate ratio to the $SiH_4$ gas, 60 SCCM of nitrogen gas, and 200 SCCM of argon gas were mixed and fed into the reaction container. High-frequency power of 200 W was applied to the gas mixture at 13.56 MHz for glow discharge, to form barrier layer 21. The pressure inside the reaction container, at that time, was approximately 0.8 torr, and the layer thickness obtained was 1.2 μm. Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$ and $SiH_4$ was adjusted to $8\times10^{-8}$. Then, high-frequency power of 400 W was applied at a reaction pressure of 1.5 torr, for 50 minutes of filming. Subsequently, the high-frequency power was reduced to zero, and the hydrogen gas, along with the other gases, was fed at a reduced flow rate of 300 SCCM for 5 minutes. After the gas flow stabilized, high-frequency power of 400 W was applied at a pressure of 1.35 torr, for 30 minutes of filming. Thereafter, the high-frequency power was reduced to zero, the hydrogen gas flow was stopped, and instead, the argon gas was fed at a flow rate 500 SCCM. When the reaction pressure reached 1.5 torr after the gas flow stabilized, high-frequency power of 400 W was applied, for 20 minutes of filming. When the photoconductive layer, obtained in this manner, was subjected to X-ray diffraction, the crystallinity varied in the order of 40% and 19% by volume with distance from substrate 21, and proved unmeasurable on the surface side. The thickness of the photoconductive layer used was 32 μm. The laser printer, mounted with the semiconductor laser of 790-nm oscillation wavelength, was used to form an image on the photosensitive member filmed in this manner. The resultant image was a distinct one, with high resolution, and was free from fog and unevenness in density. Moreover, the half-life exposure to 790-nm-wave radiation was as high as 9.5 erg/cm$^2$.

EXAMPLE 3

After an aluminum drum, for use as a conductive substrate, was washed and dried, it was heated to 350° C. while the reaction container was being gas-purged by a diffusion pump. After about one hour of heating, the degree of vacuum in the container reached $3\times10^{-5}$ torr, whereupon the drum temperature was stabilized. Then, 300 SCCM of $SiH_4$ gas, $B_2H_6$ gas with a $5\times10^{-4}$ flow-rate ratio to the $SiH_4$ gas, 60 SCCM of $CH_4$ gas, and 200 SCCM of argon gas were mixed and fed into the reaction container. High-frequency power of 200 W was applied to the gas mixture at 13.56 MHz for glow discharge, to form barrier layer 21. The pressure inside the reaction container, at that time, was approximately 0.8 torr, and the layer thickness obtained was 1.5 μm. Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$ and $SiH_4$ was adjusted to $8\times10^{-8}$. Then, high-frequency power of 450 W was applied at a reaction pressure of 1.5 torr, for 15 minutes of filming. Subsequently, the high-frequency power was reduced to zero, and the hydrogen gas, along with the other gases, was fed at a reduced flow rate of 400 SCCM for 5 minutes. After the gas flow was stabilized, high-frequency power of 450 W was applied at a pressure of 1.4 torr, for 15 minutes of filming. Thereafter, the high-frequency power was reduced to zero, and the flow rate of the hydrogen gas was lowered to 400 SCCM and maintained for 5 minutes. When the reaction pressure reached 1.4 torr after the gas flow was stabilized, high-frequency power of 450 W was applied, for 15 minutes of filming. Then, the high-frequency power was reduced to zero, and the flow rate of the hydrogen gas was lowered to 300 SCCM and maintained for 5 minutes. After the gas flow stabilized, high-frequency power of 450 W was applied at a reaction pressure of 1.35 torr, for 15 minutes of filming. Thereafter, the high-frequency power was reduced to zero, and the flow rate of the hydrogen gas was lowered to 200 SCCM and maintained for 5 minutes. Then, high-frequency power was applied at a pressure of 1.2 torr, for 30 minutes of filming. The photoconductive layer, obtained in this manner, was subjected to X-ray diffraction, and the mean grain size was calculated on the basis of the half peak width of (111) plane at a diffraction angle of 28.3 degrees. The calculation results indicated that the mean grain size varied in the order of 75, 60, 35, and 28 angstroms, in relation to the distance from substrate 21. The thickness of the photoconductive layer was 25 micrometers. Then, all the gas flows were stopped, and the container was gas-purged for 15 minutes. Thereafter, 100 SCCM of $SiH_4$ gas and 400 SCCM of nitrogen gas were fed, and high-frequency power of 200 W was applied at a reaction pressure of 0.7 torr, to form the surface layer. The laser printer, mounted with the semiconductor laser of 790-nm oscillation wavelength, was used to form an image on the photosensitive member filmed in this manner. The resultant image was a distinct one, with high resolution, and was free from fog and unevenness in density. Moreover, the half-life exposure was as high as 8 erg/cm$^2$.

EXAMPLE 4

After an aluminum drum, for use as a conductive substrate, was washed and dried, it was heated to 300° C. while the reaction container was being gas-purged by a diffusion pump. After about one hour of heating, the degree of vacuum in the container reached $3\times10^{-5}$ torr, whereupon the drum temperature was stabilized. Then, 300 SCCM of $SiH_4$ gas, $B_2H_6$ gas with a $5\times10^{-4}$ flowrate ratio to the $SiH_4$ gas, 60 SCCM of nitrogen gas, and 200 SCCM of argon gas were mixed and fed into the reaction container. High-frequency power of 200 W was applied to the gas mixture at 13.56 MHz for glow discharge, to form barrier layer 21. The pressure inside the reaction container, at that time, was approximately 0.8 torr, and the layer thickness obtained was 1.2 μm. Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$ and $SiH_4$ was adjusted to $8\times10^{-8}$. Then, high-frequency power of 400 W was applied at a reaction pressure of 1.5 torr, for 50 minutes of filming. Subsequently, the high-frequency power was reduced to zero, and the hydrogen gas, along with the other gases, was fed at a reduced flow rate of 300 SCCM for 5 minutes. After the gas flow stabilized, high-frequency power of 400 W was applied at a pressure of 1.35 torr, for 30 minutes of filming. Thereafter, the high-frequency power was reduced to zero, the hydrogen gas flow was stopped, and instead, the argon gas was fed at a flow rate 500 SCCM. When the reaction pressure reached 1.5 torr after the gas flow stabilized, high-frequency power of 400 W was applied, for 20 minutes of filming. When the photoconductive layer, obtained in this manner, was subjected to X-ray diffraction, the mean grain size varied in the order of 60 and 32 angstroms, in relation to the distance from substrate 21, and proved unmeasurable on the surface side. The thickness of the photoconductive layer used was 32 μm. The laser printer, mounted with the semiconductor laser of 790-nm oscillation wavelength, was used to form an image on the photosensitive member filmed in this manner. The resultant image was a distinct one, with high resolution, and was free from fog and unevenness in density. Moreover, the half-life exposure to 790-nm-wave radiation was as high as 9.5 erg/cm$^2$.

What is claimed is:

1. An electrophotographic photosensitive member comprising:

a conductive substrate;

a barrier layer provided on the conductive substrate; and a photosensitive layer provided on the barrier layer, at least part of said photosensitive layer being comprised of microcrystalline silicon, the crystallinity of said microcrystalline silicon varying all the way through the thickness of the photosensitive layer.

2. The electrophotographic photosensitive member according to claim 1, wherein said photosensitive layer is a photoconductive layer.

3. The electrophotographic photosensitive member according to claim 1, wherein said photosensitive layer includes a charge transfer layer formed on the barrier layer, and a charge generating layer of microcrystalline silicon, formed on the charge transfer layer.

4. The electrophotographic photosensitive member according to claim 3, wherein said charge transfer layer is comprised of amorphous silicon.

5. The electrophotographic photosensitive member according to claim 1, wherein said barrier layer is comprised of microcrystalline silicon or amorphous silicon.

6. The electrophotographic photosensitive member according to claim 1, wherein the crystallinity of said photosensitive layer ranges from 10 to 50 percent by volume.

7. The electrophotographic photosensitive member according to claim 1, wherein said barrier layer contains 0.1 to 30 atomic percent hydrogen.

8. The electrophotographic photosensitive member according to claim 1, wherein said photosensitive layer contains $10^{-7}$ to $10^{-3}$ atomic percent of an element included in group III of the periodic table.

9. The electrophotographic photosensitive member according to claim 1, wherein said photosensitive layer contains at least one element selected from carbon, oxygen, and nitrogen, by 0.1 to 20 atomic percent.

10. The electrophotographic photosensitive member according to claim 1, wherein said photosensitive layer includes microcrystalline silicon regions and amorphous silicon regions distributed mixedly.

11. The electrophotographic photosensitive member according to claim 1, wherein said photosensitive layer includes a microcrystalline silicon layer and an amorphous silicon layer stacked for lamination.

12. The electrophotographic photosensitive member according to claim 5, wherein said barrier layer contains an element included in group III or V of the periodic table.

13. The electrophotographic photosensitive member according to claim 12, wherein the group-III or -V element content of said barrier layer ranges from $10^{-3}$ to 10 atomic percent.

14. The electrophotographic photosensitive member according to claim 2, wherein the thickness of said photoconductive layer ranges from 3 to 80 μm.

15. The electrophotographic photosensitive member according to claim 5, wherein the thickness of said barrier layer ranges from 0.01 to 10 μm.

16. The electrophotographic photosensitive member according to claim 1, further comprising a surface layer of amorphous silicon formed on said photoconductive layer.

17. The electrophotographic photosensitive member according to claim 16, wherein said surface layer contains at least one element selected from carbon, oxygen, and nitrogen.

18. The electrophotographic photosensitive member according to claim 17, wherein the content of the at least one element selected from carbon, oxygen, and nitrogen of said surface layer ranges from 10 to 50 atomic percent.

* * * * *